US009433244B2

(12) United States Patent
Zhang

(10) Patent No.: US 9,433,244 B2
(45) Date of Patent: Sep. 6, 2016

(54) BRASSIERE CUP AND METHOD OF MANUFACTURE

(71) Applicant: Wenbo Zhang, Kwai Chung (HK)

(72) Inventor: Wenbo Zhang, Kwai Chung (HK)

(73) Assignee: REGINA MIRACLE INTERNATIONAL (GROUP) LIMITED, Hong Kong (HK)

( * ) Notice: Subject to any disclaimer, the term of this patent is extended or adjusted under 35 U.S.C. 154(b) by 169 days.

(21) Appl. No.: 14/100,433

(22) Filed: Dec. 9, 2013

(65) Prior Publication Data

US 2015/0157061 A1 Jun. 11, 2015

(51) Int. Cl.
*A41C 5/00* (2006.01)

(52) U.S. Cl.
CPC ..... *A41C 5/00* (2013.01)

(58) Field of Classification Search
CPC ..... A41C 3/00; A41C 3/10; A41C 3/14; A41C 3/142; A41C 3/144; A41C 5/00
USPC ..... 450/39, 54–57, 38, 37
See application file for complete search history.

(56) References Cited

U.S. PATENT DOCUMENTS

| | | | | |
|---|---|---|---|---|
| 3,202,565 | A * | 8/1965 | Loftin | 428/175 |
| 3,225,768 | A * | 12/1965 | Galitzki et al. | 450/39 |
| 5,159,659 | A * | 10/1992 | Cameron | 392/501 |
| 5,447,462 | A * | 9/1995 | Smith et al. | 450/122 |
| 5,916,829 | A * | 6/1999 | Girard et al. | 442/244 |
| 7,131,888 | B2 * | 11/2006 | Hsu | 450/39 |
| 7,887,389 | B1 * | 2/2011 | Lacambra | 450/39 |
| 8,827,765 | B2 * | 9/2014 | Zhang | 450/54 |
| 2004/0224604 | A1 * | 11/2004 | Luk | 450/39 |
| 2006/0223415 | A1 * | 10/2006 | Watrin et al. | 450/39 |
| 2007/0021035 | A1 * | 1/2007 | Bugada | 450/39 |
| 2007/0190896 | A1 * | 8/2007 | Yu | 450/39 |
| 2008/0153387 | A1 * | 6/2008 | Liu | 450/39 |
| 2008/0153388 | A1 * | 6/2008 | Liu | 450/39 |

* cited by examiner

*Primary Examiner* — Gloria Hale
(74) *Attorney, Agent, or Firm* — Ostrolenk Faber LLP

(57) ABSTRACT

There is provided a brassiere cup comprising an outermost fabric layer joined to a perimeter of a preformed cup, wherein at least part of the joint between the outermost fabric layer and the perimeter of the preformed cup has been formed by ultrasonic welding, and may be thin, neat, smooth, and seamless. There is also provided a method of joining a fabric to at least part of a perimeter of a preformed brassiere cup, wherein the joint with the perimeter is achieved by ultrasonic welding.

14 Claims, 6 Drawing Sheets

BRASSIERE CUP AND METHOD OF MANUFACTURE

FIELD OF THE INVENTION

The present invention relates to a brassiere cup that comprises an outermost fabric layer joined to the perimeter of a preformed cup, wherein at least a portion of said joint is formed by ultrasonic welding and may be thin, neat, smooth, and seamless. A method for manufacturing the brassiere cup is also provided.

BACKGROUND

A conventional brassiere comprises a pair of breast cups, a centre gore, a back strap or pair of wings which extend around the back of the wearer, and, optionally, straps which extend over the shoulders of the wearer from the breast cups to attachment points on the back wings or strap. A brassiere may also include an underwire for each breast cup to shape and support the lower periphery of each breast cup. The breast cups of a conventional brassiere often have an outermost fabric layer, the function of which is to enhance the appearance and feel of the brassiere. Such outermost layers are therefore typically made from fabrics that are particularly smooth and silky to touch, and may contain patterns or decorative features. A known method for attaching these outermost layers to the brassiere cup involves folding the fabric over to the inner-side of the perimeter of the cup, and stitching or gluing to hold the fabric in place. This can result in a joint that is clearly visible, and may cause chafing of the skin. There is hence a need for a brassiere cup with a less obtrusive joint, and a method for providing said less obtrusive joint.

SUMMARY OF THE INVENTION

A first aspect of this invention provides a method of joining a fabric to at least part of a perimeter of a preformed brassiere cup, wherein the joint with the perimeter is achieved by ultrasonic welding.

In an embodiment of this invention the process of welding also cuts the fabric along the line of the weld.

A further embodiment of this inventive method involves applying adhesive to the welded joint.

Yet further embodiments of this method include any or all of applying heat and pressure to said adhesive; applying the adhesive as a narrow layer in a line over the welded joint; and applying the adhesive in a line of between about 0.5 mm-2.5 mm, preferably about 1 mm wide, over the welded joint.

The advantage of this inventive method is that the joint formed between the fabric and preformed brassiere cup may be thin, neat, smooth, and seamless, therefore enhancing the appearance and comfort of the finished brassiere cup and brassiere.

In a second aspect of this invention the welded joint between fabric and preformed brassiere cup is made along the neckline of the preformed brassiere cup.

In a third aspect of this invention the welded joint between fabric and preformed brassiere cup is made along the underarm-edge of the preformed brassiere cup.

In a fourth aspect of this invention the welded joint between fabric and preformed brassiere cup is made along the neckline and the underarm-edge of the preformed brassiere cup.

The advantage of these aspects of the invention is that the joint between fabric and preformed brassiere cup is made along a region of the perimeter where it is particularly desirable that the joint be thin, neat, smooth, and seamless. For example the neckline region is more likely to be visible, and the underarm-edge may be more likely to cause chafing, than other regions of the perimeter.

In a fifth aspect of this invention the fabric joined to the preformed brassiere cup comprises an outermost fabric of a finished brassiere. Said outermost fabric may contain patterns or decorative features to enhance appearance.

In a sixth aspect, a preformed brassiere cup used in this invention comprises an inner fabric layer and an outer fabric layer.

In an embodiment of this aspect, a preformed brassiere cup used in this invention may comprise an inner fabric layer and an outer fabric layer, wherein at least one of said layers is laminated with a foam layer.

A seventh aspect of this invention is a finished brassiere cup containing a joint between a fabric and a preformed brassiere cup formed using any of the aspects and embodiments of the invention described previously.

An eighth aspect of this invention is a brassiere incorporating a finished brassiere cup described by any of the previous aspects.

A ninth aspect of this invention is a method for forming a finished brassiere cup, said finished brassiere cup comprising:

- a preformed cup comprising an outer fabric layer and an inner fabric layer, optionally wherein at least one of said layers is laminated with a foam layer; and
- an outermost fabric layer joined to the perimeter of said cup;

said method comprising the steps of:

- placing a fabric in contact with at least part of the perimeter of the preformed cup, such that said fabric covers at least part of the inner face of said cup; and
- using ultrasonic welding to form a welded joint between said fabric and said cup along the neckline and/or the underarm-edge of said cup, wherein the process of welding also cuts said fabric along the line of the weld; and
- applying a thin and narrow layer of adhesive over the line of said welded joint; and
- folding the now-welded-and-glued fabric over to cover the outer side of the cup; and
- joining said fabric to the remainder of the perimeter of the cup such that it forms an outermost fabric layer; and
- trimming said fabric to give the finished brassiere cup.

A further embodiment of this aspect involves applying heat and pressure to the layer of adhesive, this helps to solidify said adhesive and strengthen the joint between fabric and cup.

A tenth aspect of this invention discloses a finished brassiere cup comprising:

- a preformed brassiere cup comprising an outer fabric layer and an inner fabric layer, optionally wherein at least one of said layers is laminated with a foam layer; and
- an outermost fabric layer joined to the perimeter of said cup;
- wherein at least part of the joint between said outermost fabric layer and said cup has been formed by ultrasonic welding, and gluing.

DETAILED DESCRIPTION OF THE INVENTION

The method of manufacture of a brassiere cup in accordance with the present invention will now be described with reference to FIGS. 1 to 6B.

Figure 1:
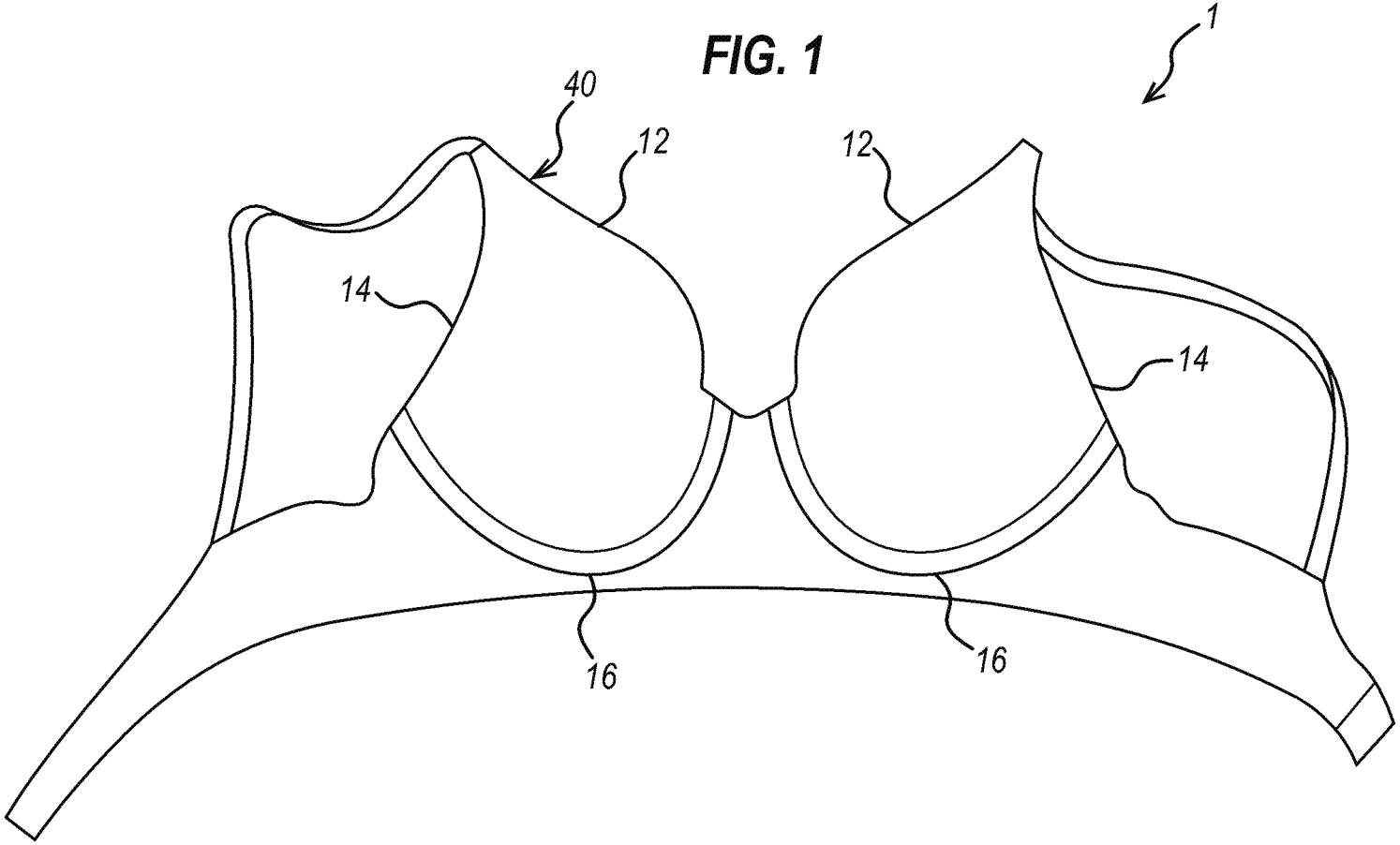
FIG. 1 shows a schematic of a brassiere with the different regions of the brassiere-cup perimeter annotated.

FIG. 1 shows a completed brassiere 1. The perimeter 40 of a typical brassiere cup consists of three regions, the neckline 12, the underarm-edge 14, and the underbreast-edge 16. One aspect of the invention describes a multi-step process for forming a joint between a fabric and at least part of the perimeter of a brassiere cup. The joint will preferably be thin, neat, smooth, and seamless as this enhances the appearance and comfort of the brassiere. In one embodiment of the invention the joint between fabric and cup is along the neckline 12. In another embodiment of the invention the joint between fabric and cup is along the underarm-edge 14, and in a further embodiment of the invention the joint between fabric and cup is along both the neckline 12 and the underarm-edge 14.

Figure 2A:
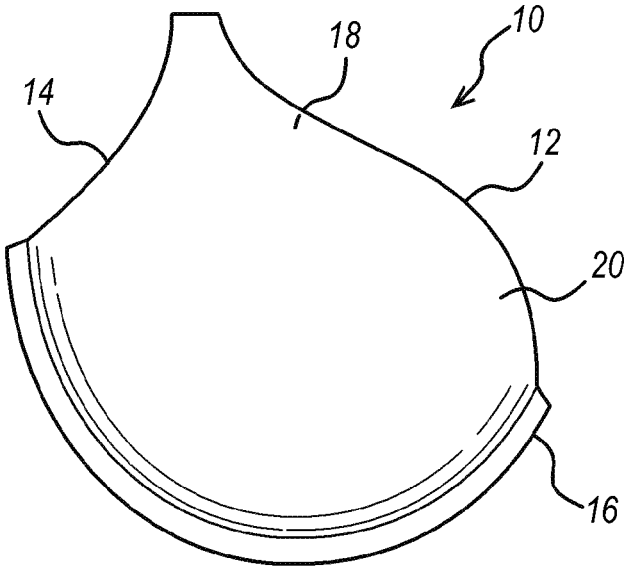
FIG. 2A shows a preformed brassiere cup and indicates its inner and outer faces.

FIG. 2A shows a preformed brassiere cup 10. This may be in a 3D shape formed by hot-press molding as is known to one skilled in the art. When a cup is in a 3D shape it will have an inner face 18 and an outer face 20. It will be understood that the inner face refers to the concave face of the brassiere that rests against the skin of the wearer, and the outer face refers to the convex face that is opposite.

Figure 2B:
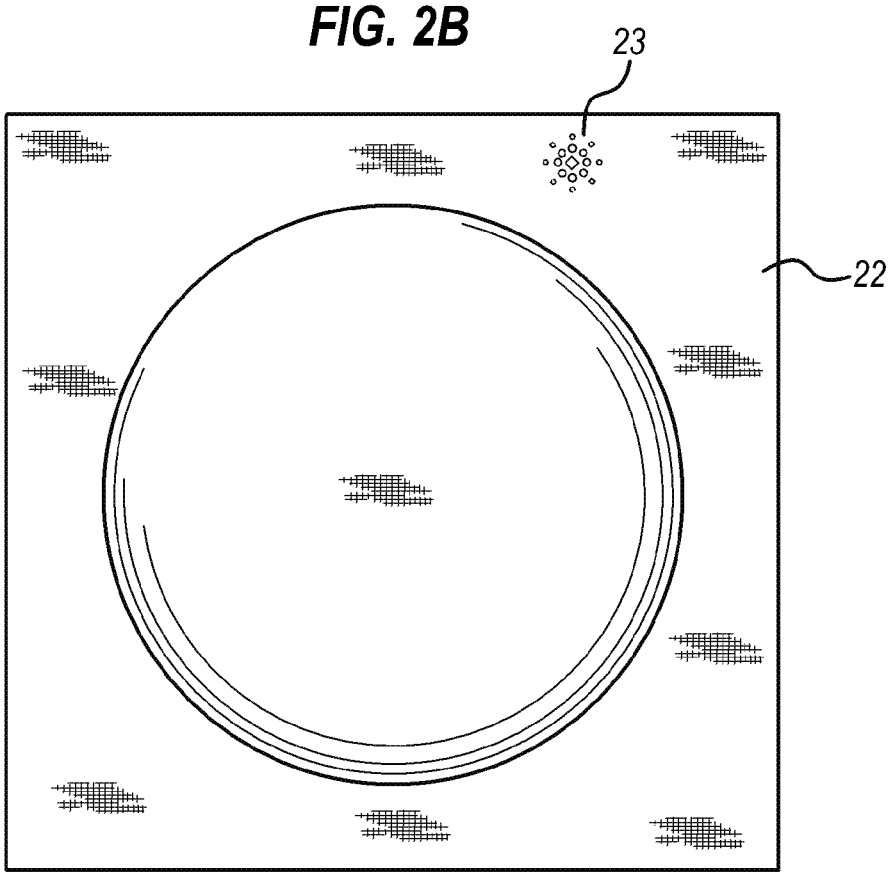
FIG. 2B shows a fabric to be joined to the preformed brassiere cup.

FIG. 2B shows a fabric 22 that can form a layer covering the outer face of a preformed cup. The fabric is subjected to molding to form a 3D shape. The fabric may contain patterns or decorative features 23 to enhance appearance. In a finished brassiere cup the fabric layer forms an outermost layer of the cup, and may be movable with respect to the preformed cup. This invention concerns a method of joining said fabric to the preformed cup, a finished brassiere cup 46 as shown in FIG. 6B incorporating such joints, and a completed brassiere 1 comprising said finished brassiere cups 46.

Figure 3A:
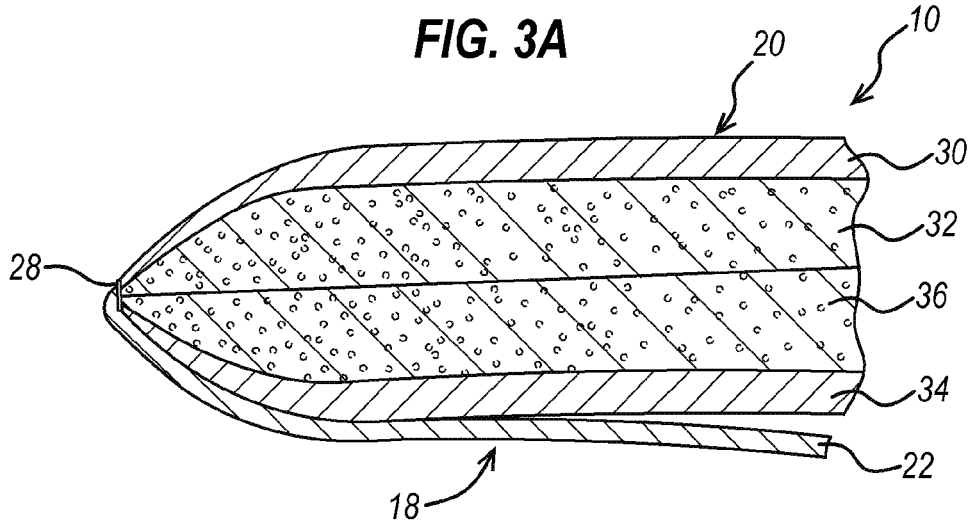
FIG. 3A shows in detail the position of the welded joint at the perimeter of the preformed brassiere cup, and an example of the fabric and foam layers that may comprise said cup.

FIG. 3A shows an example of the materials that may comprise a preformed brassiere cup 10; these are an outer fabric layer 30 which may be laminated with a foam layer 32, and an inner fabric layer 34 which may be laminated with a foam layer 36. It will be appreciated that this is merely an example of a preformed brassiere cup, and that other types of cup may be involved in the present invention. It will also be appreciated that the preformed brassiere cup may be referred to by a variety of terms including 'cup', 'molded brassiere cup', 'molded foam cup' and other such terms, and that the use of a particular term is not intended to restrict the application of this invention to one type of brassiere cup in particular.

For the avoidance of any doubt, the term 'finished brassiere cup' is not intended to rule out any further manufacturing steps being applied to said cup; 'finished' is merely referring to the completion of the method described herein. Subsequent or intermediate stages of brassiere manufacture may be carried out involving a finished brassiere cup 46, such as the application of further decorative details to the outermost layer of the cup, and the steps required to incorporate said finished brassiere cups into a completed brassiere 1.

Figure 3B:
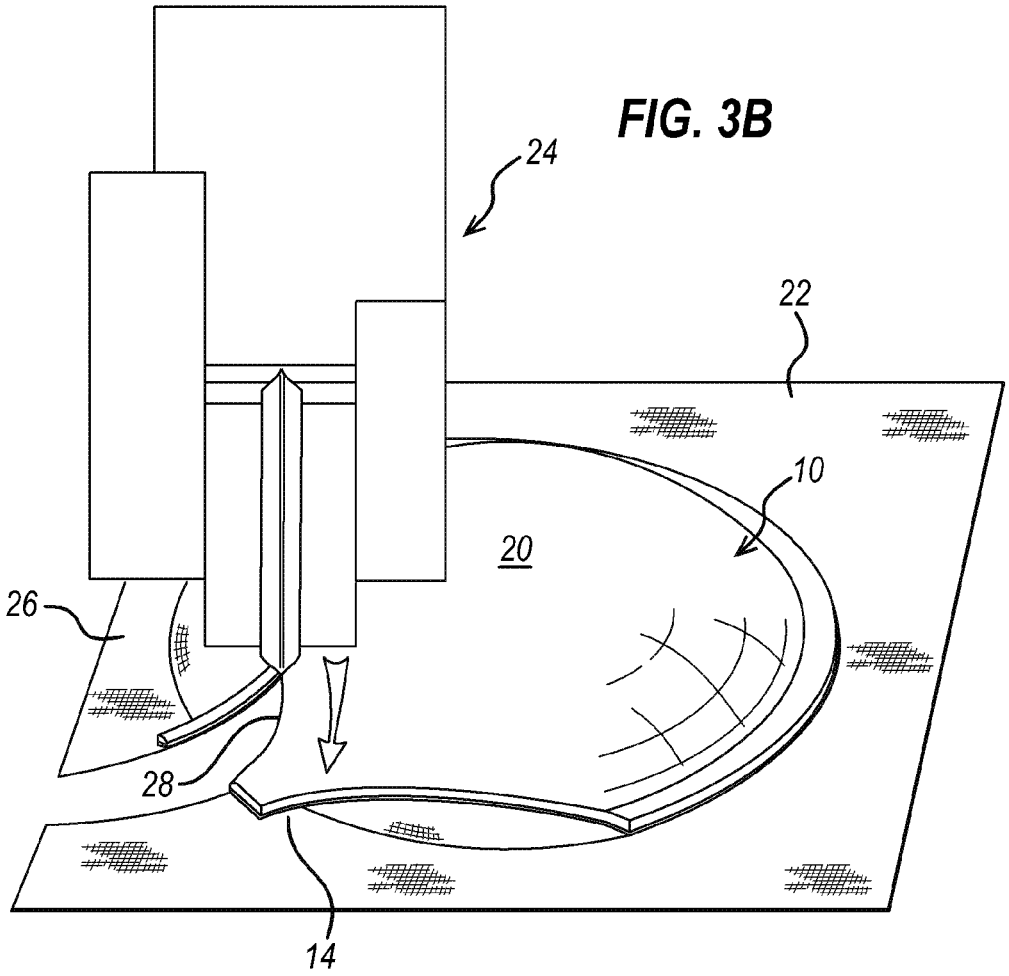
FIG. 3B shows a preformed brassiere cup placed in contact with a fabric, said fabric covering the concave inner face of said cup, and an ultrasonic cutting and welding machine forming a welded joint between fabric and cup, as well as cutting the fabric along the line of the weld at the same time, so as to trim away any excess material.

FIG. 3B shows the first step of the method of manufacture of the inventive brassiere cup. A fabric 22 is placed in contact with at least part of a perimeter of a preformed brassiere cup 10, preferably along the neckline 12 and/or the underarm-edge 14 of the cup, and preferably such that the fabric is adjacent to the inner face 18 of the cup as opposed to the outer face 20.

FIG. 3B shows the use of an ultrasonic welding machine, preferably an ultrasonic cutting-and-welding machine 24, to form a welded joint 28 between the fabric and at least part of a perimeter of the preformed cup 10. The fabric and cup are moved through the welding zone so as to weld the fabric to the cup along a line. The result of said welding is also to cut the fabric along the line of the weld 28, so removing excess hanging fabric 26 and saving time in the manufacturing process.

FIG. 3A shows that the position of the resultant ultrasonically-welded joint 28 is on the perimeter 40 of the preformed cup 10, that no excess fabric 26 is present due to the simultaneous cutting action of the preferred ultrasonic welder-and-cutter 24, and the current position of the fabric 22 adjacent to the inner face 18 of the cup.

Figure 4A:
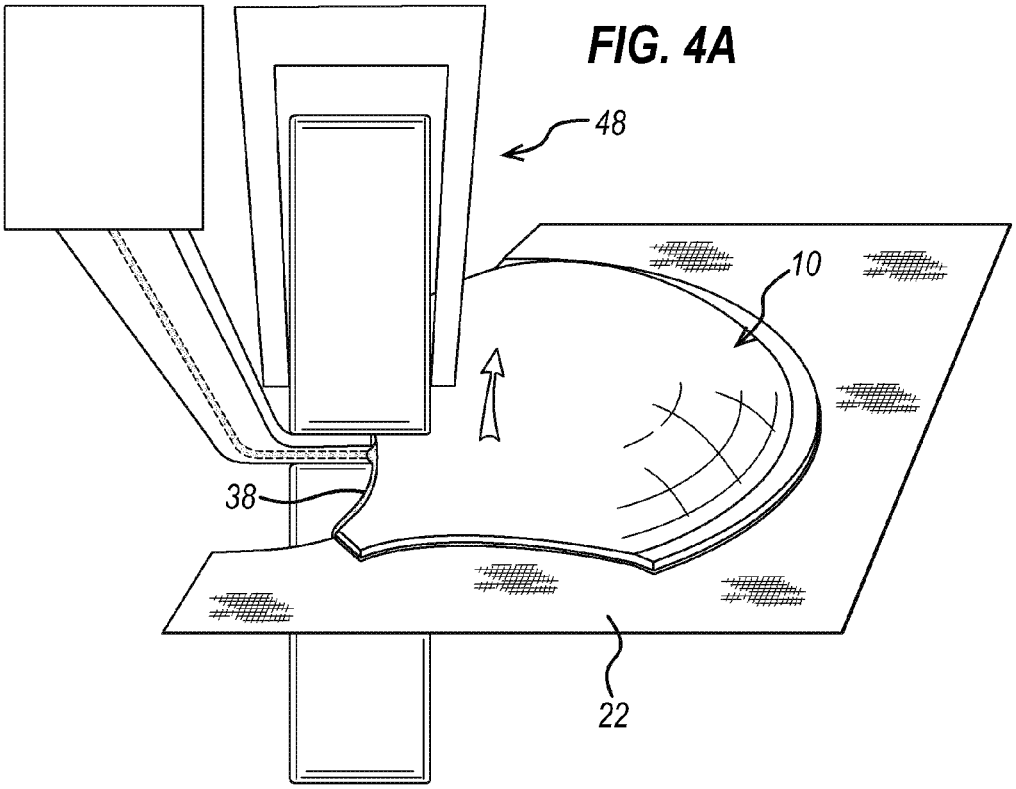
FIG. 4A shows a layer of adhesive being applied over the line of the welded joint.

FIG. 4A shows an optional but preferable further stage of the invention. A thin and narrow strip of adhesive 38 is applied as the welded joint is moved through an adhesive applicator machine 48, the result being that an adhesive is applied over the line of the welded joint to cover the joint, said adhesive acting to strengthen the joint between fabric 22 and the cup 10.

Figure 4B:
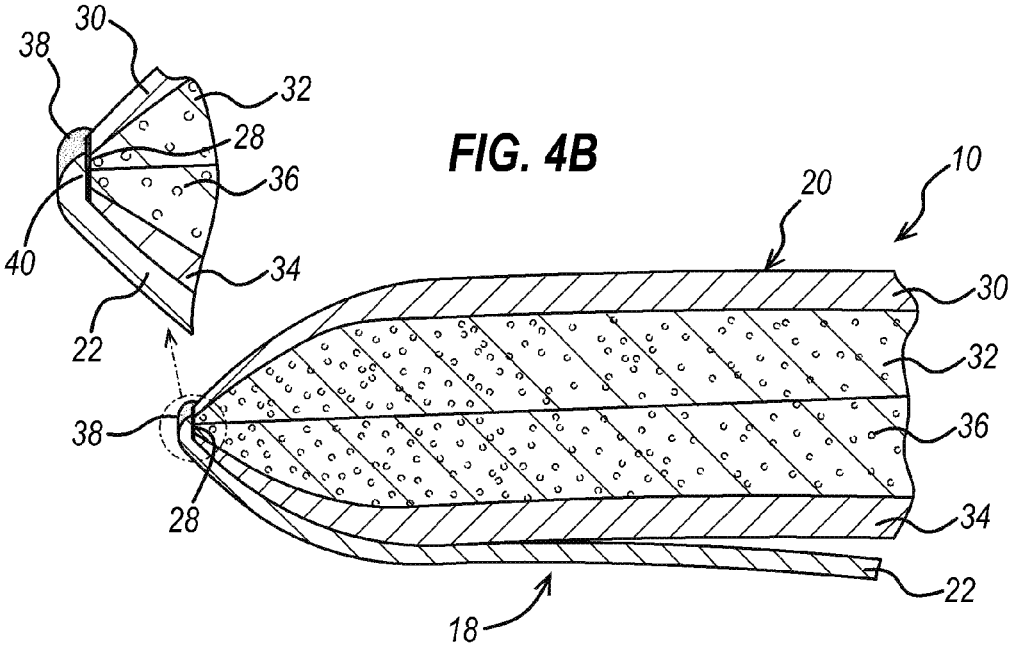
FIG. 4B shows in detail the position of the layer of adhesive covering the welded joint.

FIG. 4B shows in detail the position of the adhesive 38 at the perimeter 40 of the cup 10 and covering the weld 28. The width of the adhesive layer is approximately 1 mm. Heat and pressure may be applied to this layer to help solidify the adhesive and further strengthen the joint between fabric and cup.

Figure 5A:
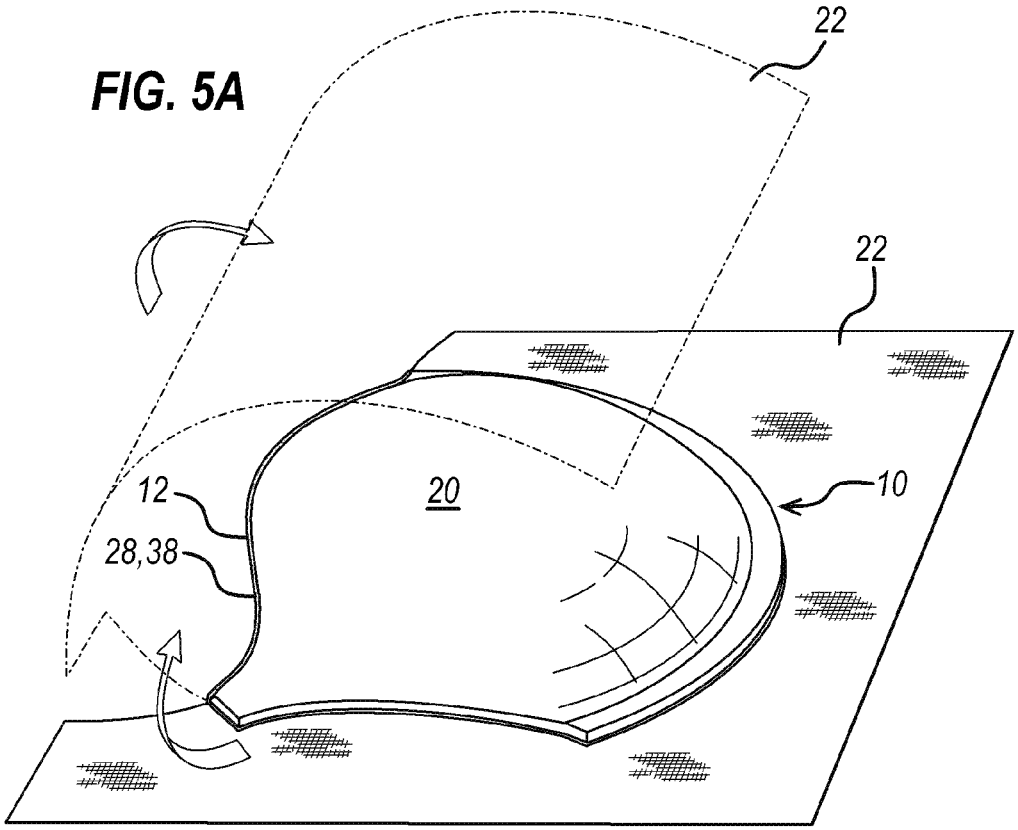
FIG. 5A shows a fabric being folded over to cover the convex outer side of a preformed brassiere cup with which it is joined.

A weld 28 formed as a result of the preferred ultrasonic welding-and-cutting process, followed by the preferred addition of an adhesive 38, is shown in FIG. 5A. This figure shows that the welding-and-cutting, then gluing, has joined a fabric 22 to part of the perimeter of a cup 10. FIG. 5A illustrates that the joint has been made along the neckline 12 of the brassiere cup; this is a particular embodiment of this invention but is not intended to restrict the invention to just this region of the cup perimeter. Alternative embodiments of the invention include, for example, joining the fabric to the cup along the underarm-edge 14, or along the neckline 12 and the underarm-edge 14, the joints being made in the manner described above.

FIG. 5A shows a further step of the invention wherein the fabric 22, once joined to the cup 10, is folded over to cover the convex outer face 20 of the cup.

Some flexibility on the part of the preformed cup is preferred as this facilitates the folding-over process. For example, a cup of the fabric-and-foam construction described in FIG. 3A will be sufficiently flexible to allow the fabric to be easily folded over to cover the convex outer face 20 of the cup.

The result of the invention is a thin, neat, smooth, and seamless joint between fabric and cup.

Figure 5B:
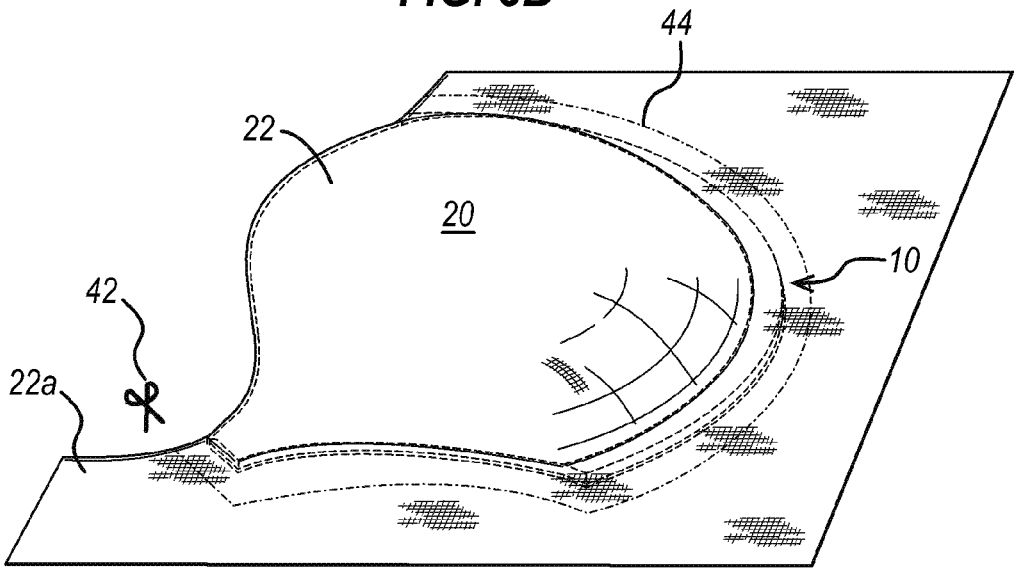
FIG. 5B shows a fabric layer covering the convex outer side of a preformed brassiere cup, with excess fabric being trimmed.

FIG. 5B shows a further step where excess fabric 22*a* is trimmed with cutting means 42 along a path 44.

Figure 6A:
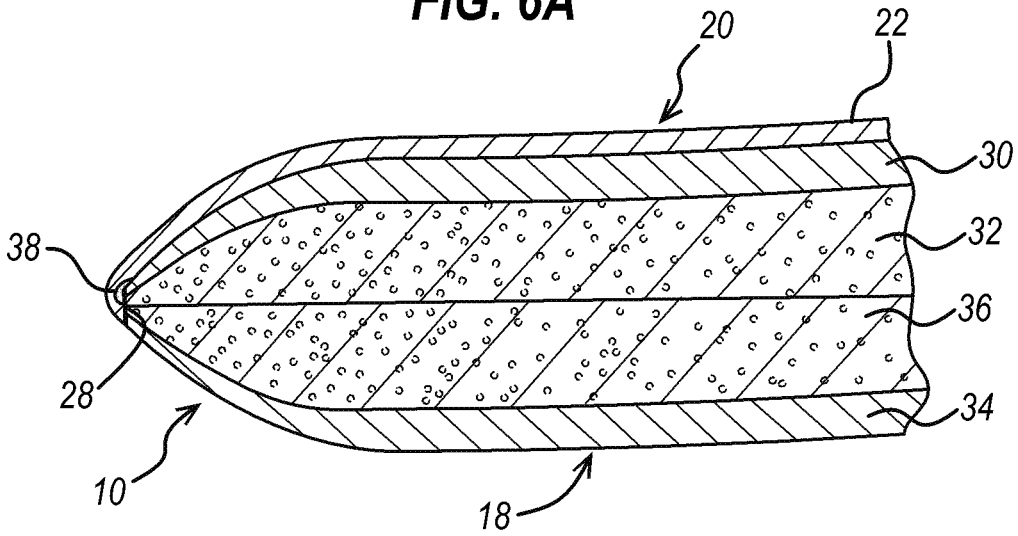
FIG. 6A shows in detail the position of the adhesive after the fabric has been folded over.
Figure 6B:
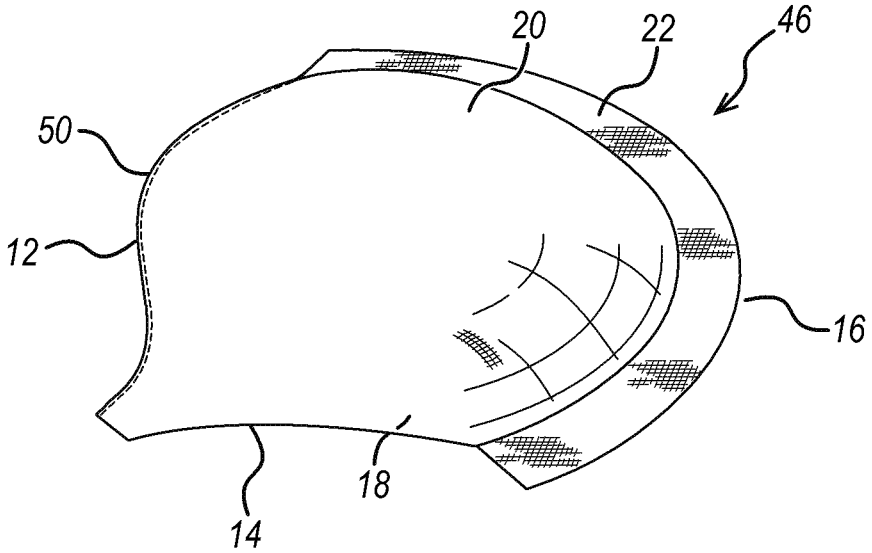
FIG. 6B shows the finished brassiere cup after the fabric has been folded over and joined to the remainder of the perimeter of the cup and the excess fabric has been trimmed.

FIG. 6A shows in detail the position of the adhesive 38 after the fabric 22 has been folded over. The adhesive is covered by the fabric 22, the advantage of this being that the joint between fabric and cup is protected in the finished brassiere cup. The final position of the fabric 22 is covering the outer face 20 of the brassiere cup. It will be appreciated from FIG. 6A that the folded-over fabric 22 is flush with or is substantially flush with the inner fabric layer 34 at the region of the joint 28, i.e., the fabric 22 and the inner fabric layer 34 form a smooth outside surface at the region of the joint 28, and the joint 28 is visible only on the inner side of the cup.

The fabric is then joined to the remainder of the perimeter of the cup by any appropriate method such as stitching or gluing, the result of this being a finished brassiere cup 46 as shown in FIG. 6B, with at least one thin, neat, smooth, and seamless joint 50. It will be clear that the fabric 22 now forms an outermost layer of the brassiere cup. The fabric may contain patterns or decorative features to enhance appearance, and subsequent manufacturing steps may be carried out, such as the addition of further decorative features, and the steps required to incorporate the finished brassiere cup 46 into a completed brassiere 1 as shown in FIG. 1.

It will of course be understood that the present invention has been described above purely by way of example only, and that modifications of detail can be made within the scope of the invention as defined in the following claims.

The invention claimed is:

1. A method of manufacturing a brassiere cup, the method comprising the step of joining a first fabric layer to at least part of a perimeter of a preformed brassiere cup, wherein the joint of the first fabric layer with the perimeter is achieved by a process of ultrasonic welding and gluing with an adhesive, wherein:

the adhesive is applied over a weld formed by the process of ultrasonic welding, the adhesive is covered by the first fabric layer, and the first fabric layer covers and contacts a second fabric layer included in the preformed brassiere cup.

2. The method of claim 1 wherein the process of ultrasonic welding also cuts the first fabric layer along a line of the weld formed by the process of ultrasonic welding.

3. The method of claim 1 wherein heat and pressure are applied to the adhesive.

4. The method of claim 1 wherein the adhesive is applied as a narrow layer in a line over the weld formed by the process of ultrasonic welding.

5. The method of claim 4 wherein a width of the adhesive layer is about 1 mm.

6. The method of claim 1 wherein the first fabric layer is joined to the preformed brassiere cup along a neckline of the preformed brassiere cup.

7. The method of claim 1 wherein the first fabric layer is joined to the preformed brassiere cup along an underarm-edge of the preformed brassiere cup.

8. The method of claim 1 wherein the first fabric layer is an outermost fabric layer.

9. The method of claim 1 wherein:

the preformed brassiere cup comprises an inner fabric layer and an outer fabric layer and one of the inner fabric layer and the outer fabric layer is the second fabric layer.

10. The method of claim 9 wherein at least one of the inner and outer fabric layers of the preformed brassiere cup is laminated with a foam layer.

11. A finished brassiere cup formed using the method of claim 1, wherein:

the process of ultrasonic welding also cuts the fabric layer along a line of the weld formed by the process of ultrasonic welding, the preformed brassiere cup comprises an inner fabric layer and an outer fabric layer, and one of the inner fabric layer and the outer fabric layer is the second fabric layer.

12. A brassiere incorporating two finished brassiere cups, each finished brassiere cup of the two finished brassiere cups being formed as claimed in claim 11, a center gore, and a back strap.

13. A method for forming a finished brassiere cup, said finished brassiere cup comprising:

a preformed cup comprising an outer fabric layer and an inner fabric layer, and an outermost fabric layer joined to a perimeter of the preformed cup;

the preformed cup optionally comprising at least one foam layer laminated to at least one of the outer fabric layer and the inner fabric layer;

said method comprising the steps of:

placing a fabric layer in contact with at least part of the perimeter of the preformed cup, such that said fabric layer covers at least part of an inner face of the preformed cup;

using ultrasonic welding to form a welded joint between said fabric layer and said preformed cup along a neckline and/or an underarm-edge of said preformed cup, wherein the process of ultrasonic welding also cuts said fabric layer along a line of the welded joint;

applying a thin and narrow layer of adhesive over the line of the welded joint;

folding the now-welded-and-glued fabric layer over to cover and contact the outer fabric layer on an outer side of the preformed cup;

joining said fabric layer to a remainder of the preformed cup such that it forms an outermost fabric layer; and trimming the outermost fabric layer to form the finished brassiere cup, wherein the adhesive layer is covered by the outermost fabric layer.

14. A finished brassiere cup comprising:

a preformed brassiere cup comprising an outer fabric layer and an inner fabric layer; and an outermost fabric layer joined to a perimeter of said preformed brassiere cup and covering and contacting the outer fabric layer;

the preformed brassiere cup optionally comprising at least one foam layer laminated to at least one of the outer fabric layer and the inner fabric layer;

wherein at least part of the joint between said outermost fabric layer and said perimeter of said preformed brassiere cup has been formed by a process of ultrasonic welding, and gluing with an adhesive applied over a weld formed by the process of ultrasonic welding, and the adhesive is covered by the outermost fabric layer.

* * * * *